US006672405B2

(12) United States Patent
Tolman et al.

(10) Patent No.: US 6,672,405 B2
(45) Date of Patent: Jan. 6, 2004

(54) PERFORATING GUN ASSEMBLY FOR USE IN MULTI-STAGE STIMULATION OPERATIONS

(75) Inventors: Randy C. Tolman, Spring, TX (US); David A. Kinison, Kingwood, TX (US); Kris J. Nygaard, Houston, TX (US); William A. Sorem, Katy, TX (US); Timothy J. Hall, Houston, TX (US); Jeffrey R. Bailey, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 39 days.

(21) Appl. No.: 10/173,918

(22) Filed: Jun. 18, 2002

(65) Prior Publication Data

US 2002/0189802 A1 Dec. 19, 2002

Related U.S. Application Data

(60) Provisional application No. 60/299,248, filed on Jun. 19, 2001.

(51) Int. Cl.[7] ..... E21B 43/119

(52) U.S. Cl. ..... 175/4.52; 175/4.51; 166/297

(58) Field of Search ..... 166/66.5, 297, 166/55.1, 284, 100, 281; 175/4.51, 4.57, 4.6, 4.52

(56) References Cited

U.S. PATENT DOCUMENTS

| | | | | |
|---|---|---|---|---|
| 2,067,408 A | | 1/1937 | Morris | 102/4 |
| 2,925,775 A | | 2/1960 | McKee | 102/20 |
| 2,968,243 A | | 1/1961 | Turechek | 102/20 |
| 2,986,214 A | | 5/1961 | Wiseman, Jr. et al. | 166/55 |
| 3,028,914 A | | 4/1962 | Flickinger | 166/42 |
| 3,111,988 A | | 11/1963 | Davis et al. | 166/42 |
| 3,118,501 A | | 1/1964 | Kenley | 166/55.4 |
| 3,366,188 A | | 1/1968 | Hicks | 175/4.6 |
| 3,427,652 A | | 2/1969 | Seay | 166/250 |
| 3,429,384 A | | 2/1969 | Shore | 175/4.6 |
| 3,547,198 A | | 12/1970 | Slusser | 166/284 |
| 3,599,719 A | * | 8/1971 | Brown | 166/297 |
| 3,662,833 A | | 5/1972 | Kisling, III | 166/314 |
| 3,712,379 A | | 1/1973 | Hill | 166/297 |
| 3,739,723 A | | 6/1973 | Hakala | 102/20 |
| 3,874,461 A | | 4/1975 | Cocanower | 175/4.6 |
| 4,102,401 A | | 7/1978 | Erbstoesser | 166/284 |
| 4,113,314 A | | 9/1978 | Savanick et al. | 299/4 |

(List continued on next page.)

OTHER PUBLICATIONS

Stipp, Louis C. and Williford, R.A. *Pseudolimited Entry: A Sand Fracturing Technique for Simultaneous Treatment of Multiple Pays*, Journal of Petorleum Technology (May 1968) pp. 457–462.

(List continued on next page.)

*Primary Examiner*—Frank Tsay
(74) *Attorney, Agent, or Firm*—Pamela L. Wilson

(57) ABSTRACT

A perforating gun assembly for use in perforating multiple intervals of at least one subterranean formation intersected by a cased wellbore and in treating the multiple intervals using a diversion agent, such as ball sealers. In one embodiment, the apparatus of the present invention comprises a perforating assembly having a plurality of select-fire perforating devices interconnected by connector subs, with each of the perforating devices having multiple perforating charges. The apparatus also includes at least one decentralizer, attached to at least one of the perforating devices, which is adapted to eccentrically position the perforating assembly within the cased wellbore so as to create sufficient ball sealer clearance between the perforating assembly and the inner wall of the cased wellbore to permit passage of at least one ball sealer.

50 Claims, 7 Drawing Sheets

U.S. PATENT DOCUMENTS

| | | | | | |
|---|---|---|---|---|---|
| 4,137,182 | A | | 1/1979 | Golinkin | 252/8.55 R |
| 4,139,060 | A | | 2/1979 | Muecke et al. | 166/281 |
| 4,193,460 | A | * | 3/1980 | Gilbert | 175/4.6 |
| 4,244,425 | A | | 1/1981 | Erbstoesser | 166/284 |
| 4,287,952 | A | * | 9/1981 | Erbstoesser | 166/284 |
| 4,415,035 | A | | 11/1983 | Medlin et al. | 166/308 |
| 4,438,810 | A | * | 3/1984 | Wilkinson | 175/4.51 |
| 4,637,468 | A | | 1/1987 | Derrick | 166/297 |
| 4,671,352 | A | | 6/1987 | Magee, Jr. et al. | 166/186 |
| 4,702,316 | A | | 10/1987 | Chung et al. | 166/272 |
| 4,776,393 | A | | 10/1988 | Forehand et al. | 166/55.1 |
| 4,809,781 | A | | 3/1989 | Hoefner | 166/273 |
| 4,867,241 | A | | 9/1989 | Strubhar | 166/308 |
| 5,025,861 | A | | 6/1991 | Huber et al. | 166/297 |
| 5,131,472 | A | | 7/1992 | Dees et al. | 166/308 |
| 5,161,618 | A | | 11/1992 | Jones et al. | 166/308 |
| 5,309,995 | A | | 5/1994 | Gonzalez et al. | 166/284 |
| 5,314,019 | A | | 5/1994 | Honarpour | 166/270 |
| 5,353,875 | A | | 10/1994 | Schultz et al. | 166/297 |
| 5,390,741 | A | | 2/1995 | Payton et al. | 166/284 |
| 5,485,882 | A | | 1/1996 | Bailey et al. | 166/284 |
| 5,513,703 | A | | 5/1996 | Mills et al. | 166/55.1 |
| 5,579,844 | A | | 12/1996 | Rebardi et al. | 166/296 |
| 5,598,891 | A | | 2/1997 | Snider et al. | 166/308 |
| 5,669,448 | A | | 9/1997 | Minthorn et al. | 166/308 |
| 5,704,426 | A | | 1/1998 | Rytlewski et al. | 166/297 |
| 5,755,286 | A | | 5/1998 | Ebinger | 166/281 |
| 5,803,178 | A | | 9/1998 | Cain | 166/306 |
| 5,865,252 | A | | 2/1999 | van Petegem et al. | 166/297 |
| 5,890,536 | A | | 4/1999 | Nierode et al. | 166/284 |
| 5,934,377 | A | | 8/1999 | Savage | 166/281 |
| 5,947,200 | A | | 9/1999 | Montgomery | 166/281 |
| 5,954,133 | A | | 9/1999 | Ross | 166/297 |
| 5,990,051 | A | | 11/1999 | Ischy et al. | 507/204 |
| 5,996,687 | A | | 12/1999 | Pringle et al. | 166/66.6 |
| 6,186,230 | B1 | | 2/2001 | Nierode | 166/250.1 |
| 6,189,621 | B1 | | 2/2001 | Vail, III | 166/385 |
| 6,257,332 | B1 | | 7/2001 | Vidrine et al. | 166/250.15 |
| 6,296,066 | B1 | | 10/2001 | Terry et al. | 175/92 |
| 6,394,184 | B2 | | 5/2002 | Tolman et al. | 166/281 |

OTHER PUBLICATIONS

Williams, B.B., Nieto, G., Graham, H.L., and Leibach R.E. *A Staged Fracturing Treatment for Multisand Intervals*, Journal of Petroleum Technology (Aug. 1973) pp. 897–904.

Von Albrecht, C., Diaz, B., Salathiel, W.M., and Nierode, D.E., *Stimulation of Asphaltic Deep Wells and Shallow Wells in Lake Maracaibo, Venezuela, 10th World Petroleum Congress*, PD7, Bucharest, Romania (1979) pp. 55–62.

Warpinski, N.R., Branagan, P.T., Lorenz, J.C., Northrop, D.A., and Frohne, K.H. *Fracturing and Testing Case Study of Paludal, Tight, Lenticular Gas Sands, SPE/DOE 1985 Low Permeability Gas Reservoirs*, Denver, Colorado Paper No. SPE/DOE 13876 (May 9–22, 1985) pp. 267–278.

Sattler, A.R., Hudson, P.J., Raible, C.J., Gall, B.L., and Maloney D.R. *Laboratory Studies for the Design and Analysis of Hydraulic Fractured Stimulations in Lenticular, Tight Gas Reservoirs, Unconventional Gas Technology Symposium*, Louisville, KY, Paper No. SPE 15245 (May 18–21, 1986) pp. 437–447.

Cipolla, Craig L. *Hydraulic Fracture Technology in the Ozona Canyon and Penn Sands, Permian Basin Oil & Gas Recovery Conference*, Midland, Texas, Paper No. SPE 35196 (Mar. 27–29, 1996) pp. 455–466.

Cipolla, Craig L.and Woods, Mike C. *A Statistical Approach to Infill Drilling Studies: Case History of the Ozona Canyon Sands, Gas Technology Conference*, Calgary, Alberta, Canada Paper No. SPE 35628 (Apr. 28–May 1, 1996) pp. 493–497.

Webster, K.R., Goins Jr., w.C. and Berry, S.C. *A Continuous Multistage Fracturing Technique, Journal of Petroleum Technology* (Jun., 1965) pp. 619–625.

Kordziel, Walter R., Rowe, Wayne, Dolan, V.B., and Ritger, Scott D. *A Case Study of Intergrating Well–Logs and a Pseudo 3D Multi–Layer Frac Model to Optimize Exploitation of Tight Lenticular Gas Sands, European Petroleum Conference*, Milan Italy, Paper No.SPE 36886 (Oct. 22–24, 1996) pp.129–141.

Kuuskraa, Vello A., Prestridge, Andrew L., and Hansen, John T. *Advanced Technologies for Producing Massively Stacked Lenticular Sands, Gas Technology Conference*, Calgary, Alberta, Canada, Paper No. SPE 35630 (Apr. 28–May 1, 1996) pp. 505–514

Bennion, D.B., Thomas, F.B., and Bietz, R.F. *Low–Permeability Gas Reservoirs: Problems, Opportunities and Solutions for Drilling, Completion, Stimulation and Production, Gas Technology Conference*, Calgary, Alberta, Canada, Paper No. SPE 35577 (Apr. 28–May 1, 1996) pp. 117–131.

Peterson, R.E., and Kohout Julie. *An Approximation of Continuity of Lenticular Mesaverde Sandstone Lenses Utilizing Close–Well Correlations, Piceance Basin, Northwestern Colorado, 1983 SPE/DOE Low Permeability Gas Reservoirs*, Denver, Colorado Paper No. SPE/DOE 11610 (Mar. 14016, 1983) pp. 1–5.

* cited by examiner

PERFORATING GUN ASSEMBLY FOR USE IN MULTI-STAGE STIMULATION OPERATIONS

RELATED U.S. APPLICATION DATA

This application claims the benefit of U.S. Provisional Application No. 60/299,248, filed Jun. 19, 2001.

FIELD OF INVENTION

This invention relates generally to the field of perforating and stimulating subterranean formations to increase the production of oil and gas therefrom. More specifically, the invention provides a new and improved perforating gun assembly for use in multiple-stage stimulation operations using a diversion agent, such as ball sealers.

BACKGROUND OF THE INVENTION

Naturally occurring deposits of oil and gas are typically produced using wells drilled from the earth's surface. A wellbore penetrating a subterranean formation typically consists of a metal pipe (casing) cemented into the original drill hole. Lateral holes (perforations) are shot through the casing and the cement sheath surrounding the casing to allow hydrocarbon flow into the wellbore and, if necessary, to allow treatment fluids to flow from the wellbore into the formation.

When a hydrocarbon-bearing, subterranean reservoir formation does not have enough permeability or flow capacity for the hydrocarbons to flow to the surface in economic quantities or at optimum rates, hydraulic fracturing or chemical (often acid) stimulation may be used to increase the flow capacity. Hydraulic fracturing consists of injecting viscous fluids into the formation through the perforations at such high pressures and rates that the reservoir rock fails and forms a plane, typically vertical, fracture or fracture network. Granular proppant material, such as sand, ceramic beads, or other materials, is generally injected with the later portion of the fracturing fluid to hold the fracture(s) open after the pump pressures are released. Increased flow capacity from the reservoir results from the high permeability flow path left between the grains of the proppant material within the fracture(s). In chemical stimulation treatments, flow capacity is improved by dissolving materials in the formation or otherwise changing formation properties.

When multiple hydrocarbon-bearing zones are stimulated by hydraulic fracturing or chemical stimulation treatments, economic and technical gains are realized by injecting multiple treatment stages that can be diverted (or separated) by various means, including the use of ball sealers. The primary advantages of ball sealer diversion are low cost and low risk of mechanical problems. Costs are low because the process can typically be completed in one continuous operation, usually during just a few hours. Only the ball sealers are left in the wellbore to either flow out with produced hydrocarbons or drop to the bottom of the well in an area known as the rat (or junk) hole. The primary disadvantage is the inability to be certain that only one set of perforations in the desired interval will fracture at a time so that the correct number of ball sealers are dropped at the end of each treatment stage. Obtaining optimal benefits from the process depends on one fracture treatment stage entering the formation through only one perforation set and all other open perforations remaining substantially unaffected during that stage of treatment. Further disadvantages are lack of certainty that all of the perforated intervals will be treated and of the order in which these intervals are treated while the job is in progress. In some instances, it may not be possible to control the treatment so that individual zones are treated with single treatment stages.

One multi-stage treatment method which employs the use of ball sealers is the "Just-in-Time Perforating" ("JITP") method disclosed in co-pending patent application Ser. No. 09/891,673 filed Jun. 25, 2001. The JITP stimulation method is a method for individually treating each of multiple intervals within a wellbore while maintaining the economic benefits of multi-stage treatment: it provides a method for designing the treatment of multiple perforated intervals so that only one such interval is treated during each treatment stage while at the same time determining the sequence in which intervals are treated. One of the primary benefits of the JITP method is that it allows more efficient chemical and/or fracture stimulation of many zones, leading to higher well productivity and higher hydrocarbon recovery (or higher injectivity) than would otherwise have been achieved.

More specifically, the method involves perforating, treating, and isolating a given zone, and continuously and sequentially performing the same process for a number of zones up the well. The JITP process proceeds generally as follows: A select-fire perforating gun assembly, consisting of multiple gun sections containing shaped charges, is sent downhole via wireline to the first zone of interest. Each gun section can be individually fired via electric signal transmitted by the wireline. The first gun section is fired to form perforations in the well casing at the first zone. The gun assembly is then immediately pulled up hole to the next zone to be treated. The first stage of treatment is pumped into the wellbore and forced to enter the first set of perforations. Ball sealers are pumped down the well with the later portion of the treatment and ultimately seat on the perforations, thus isolating the first zone. The second gun section is then fired to create perforations at the second zone, and the gun assembly is pulled up hole to the next zone to be treated. The second stage of treatment is pumped while maintaining a high pressure in the wellbore, thus ensuring that the ball sealers on the previous set of perforations remain seated and that the treatment is diverted to the current perforated zone. The process is repeated for each zone to be treated.

There are several potential problems which could arise during the JITP stimulation process that could either limit the number of zones treated during a given trip downhole or affect the quality of the individual treatments. For example, the perforations may have burrs (sharp pieces of well casing metal extruding from the perforations into the wellbore) that form as a result of the firing process of shaped charges. These burrs can be non-uniform or very large about the perforation circumference, and as a result the ball sealers may not properly seat on the perforations. Treatment fluid may then leak past the ball sealers, which could result in that zone being over-treated and thus failure to optimally divert the treatment fluid to the current zone of interest, which in turn could lead to sub-optimal production out of one or more zones.

Depending on the distance between the outer wall of the gun section housing and the well casing, known as the "shot clearance", and the positioning of the shaped charges about the circumference of the gun assembly, known as the "shot phasing," the diameter of the perforations made may be variable. Typically, the greater the shot clearance, the smaller the diameter of the perforation made by the shaped charge. If the gun assembly drifts or is forced to one side of the wellbore, and the shot phasing is such that shaped charges are aimed at various locations about the wellbore circumference, the resulting perforations may have a significant variation in diameter and ovality; the larger perforations will be more likely to take the treatment fluid since they will have less frictional pressure losses. The size and shape of the perforations can also affect the seating of the ball sealers, where excessively large and small perforations or oval-shaped perforations may not allow the balls to seat and seal optimally. It may also compromise their mechanical integrity.

During each treatment stage of the JITP process, the ball sealers must travel downhole past the gun assembly to reach their destination. If the gun assembly has an outer diameter relative to the well casing inner diameter such that the annular area between the gun assembly and the inner wall of the well casing is small, then the ball sealers may have difficulty getting past the gun assembly. As a result the ball sealers may get lodged in part of the assembly or between the gun assembly and the well casing. Even if the gun assembly has a moderately sized outer diameter but is centralized in the well casing, the ball sealers may become lodged between the gun assembly and the casing or within the components of the gun assembly. The treatment may be compromised if even one of the ball sealers fails to make it past the perforating assembly or is temporarily hindered from reaching the targeted perforation of the treated zone.

Since the JITP process involves over-balanced perforating (i.e., maintaining high pressure in the wellbore while perforating), opening up a new set of perforations can cause a large pressure differential between the wellbore and the formation. This pressure imbalance can cause the gun assembly to get sucked against the perforations before it can be pulled up hole to the next interval. This sticking force may be so great that the wireline may not be sufficiently strong to overcome the frictional force between the gun assembly and well casing. The only way to unstick the gun may be to lower the wellbore pressure. However, this may cause the ball sealers on the previously completed zones to unseat, reducing the diversion effectiveness and possibly causing the treatment to be terminated.

The various embodiments of the inventive perforating gun assembly and the various novel components described below serve to address one or more of these problems described above.

SUMMARY OF THE INVENTION

The various embodiments of the apparatus of the present invention are for use in perforating multiple intervals of at least one subterranean formation intersected by a cased wellbore and in treating the multiple intervals using a diversion agent, such as ball sealers. In one embodiment, the apparatus of the present invention comprises a perforating assembly having a plurality of select-fire perforating devices interconnected by connector subs, with each of the perforating devices having multiple perforating charges. The apparatus also includes at least one decentralizer, attached to at least one of the perforating devices, which is adapted to eccentrically position the perforating assembly within the cased wellbore so as to create sufficient ball sealer clearance between the perforating assembly and the inner wall of the cased wellbore to permit passage of at least one ball sealer. The apparatus may also include one or all of the following components: (i) at least one stand-off adapted to create an imposed shot clearance between the perforating assembly and the inner wall of the cased wellbore when the perforating assembly is eccentrically positioned, (ii) means for creating burr-free perforations in the cased wellbore upon firing of the perforating charges, (iii) a depth locator for monitoring the depth of the perforating assembly, and (iv) a bridge plug and corresponding bridge plug setting tool for isolating previously completed intervals of the formation.

In another embodiment, the apparatus comprises at least one select-fire perforating device having multiple perforating charges and at least one decentralizer adapted to eccentrically position the perforating device within the cased wellbore so as to create sufficient ball sealer clearance between the perforating device and the inner wall of the cased wellbore to permit passage of at least one ball sealer. The apparatus may also include one or more of the components listed above.

In other embodiments, the apparatus of the present invention is used in perforating multiple intervals of at least one subterranean formation intersected by a cased wellbore and in treating the multiple intervals using a diversion agent such as sand, ceramic materials, proppant, salt, polymers, waxes, resins, viscosified fluids, foams, gelled fluids or chemically formulated fluids. In one embodiment, the apparatus comprises a perforating assembly comprising a plurality of select-fire perforating devices interconnected by connector subs, with each of the perforating devices having multiple perforating charges. The apparatus also includes at least one decentralizer, attached to at least one of the perforating devices, which is adapted to eccentrically position the perforating assembly within the cased wellbore. The perforating assembly is eccentrically positioned so as to create sufficient diversion agent clearance between the perforating assembly and the inner wall of the cased wellbore to (i) permit passage of a diversion agent with reduced frictional losses when the diversion agent flows past the perforating assembly and (ii) to treat at least one of the multiple intervals following perforation of the interval. This embodiment may also include one or more of the other components listed above.

BRIEF DESCRIPTION OF THE DRAWING

The present invention and its benefits will be better understood by referring to the attached FIGS. 1–9 where.

DETAILED DESCRIPTION OF THE INVENTION

Figure 1:
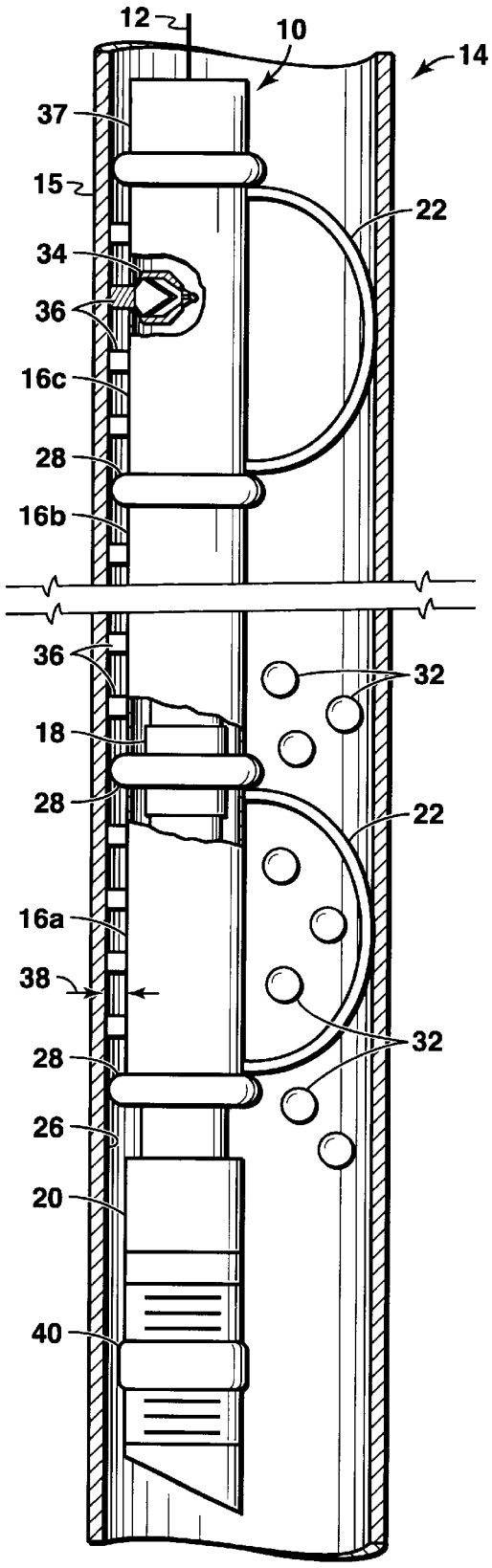
FIG. 1 illustrates one embodiment of the perforating gun assembly of the present invention for use in multi-stage stimulation operations.

FIG. 1 illustrates one embodiment of the apparatus 10 of the present invention. The apparatus 10 is hung by wireline 12 in a cased wellbore 14 having a casing 15. The apparatus 10 includes a perforating assembly comprising a plurality of select-fire perforating devices 16*a*, 16*b* and 16*c*, which are interconnected by connector subs 18. It should be understood that although the apparatus 10 illustrated in FIG. 1 has three select-fire perforating devices, in actual practice the apparatus may have many more than three select-fire perforating devices. Each of the select-fire perforating devices 16 has multiple perforating charges 34. As used herein, the term "select-fire" refers to the network of interconnected charges. The perforating charges can be shaped charges or bullets. A shaped charge consists of a pressed powdered metal liner that, when melted by an ignited propellant, forms a liquid jet that penetrates the well casing and formation; a bullet perforator consists of a solid metal projectile fired by a similar ignited propellant. A set of charges may be individually arranged in such a network or banks of perforating devices having multiple charges may be arranged in a network. This network is designed to allow each successive node in the network to be fired individually, commonly known as a "select-fire" system. The perforating devices 16 consist of the gun carrier sleeve (42, FIG. 2), shaped charges 34, and associated parts well known to those skilled in the art for firing the shaped charges 34. The number of perforating devices 16 may depend on the number of zones to be treated in a given trip downhole and/or the number of perforations desired for a given zone. The length of each perforating device 16 may also depend on the number of perforations required for each zone. However, each perforating device 16 should be short enough to ensure it has sufficient strength to resist bending from the large pressure differentials that can cause the perforating assembly to stick. In the case of short perforating devices 16, it may be necessary to fire multiple perforating devices 16 at once to get the desired number of perforations in a given zone.

The outer diameter of the perforating device 16 depends on the inside diameter of the well casing 15 and the size of the ball sealers 32. A ball sealer is ordinarily a small spherical device used to temporarily plug a perforation and is held in place by the pressure differential between the wellbore and the formation: however, the term "ball sealer" need not be limited in terms of the size, shape or composition. The outer diameter of the perforating devices 16 should be determined so as to ensure sufficient clearance for the transport of at least one ball sealer 32 past the perforating assembly, with consideration of any stand-off 28 component (described further below). In one embodiment the shot phasing of the shaped charges 34 is such that all shots are taken at about the same amount of shot clearance to ensure that the diameter of the resulting perforations does not have significant variation.

Figure 2:
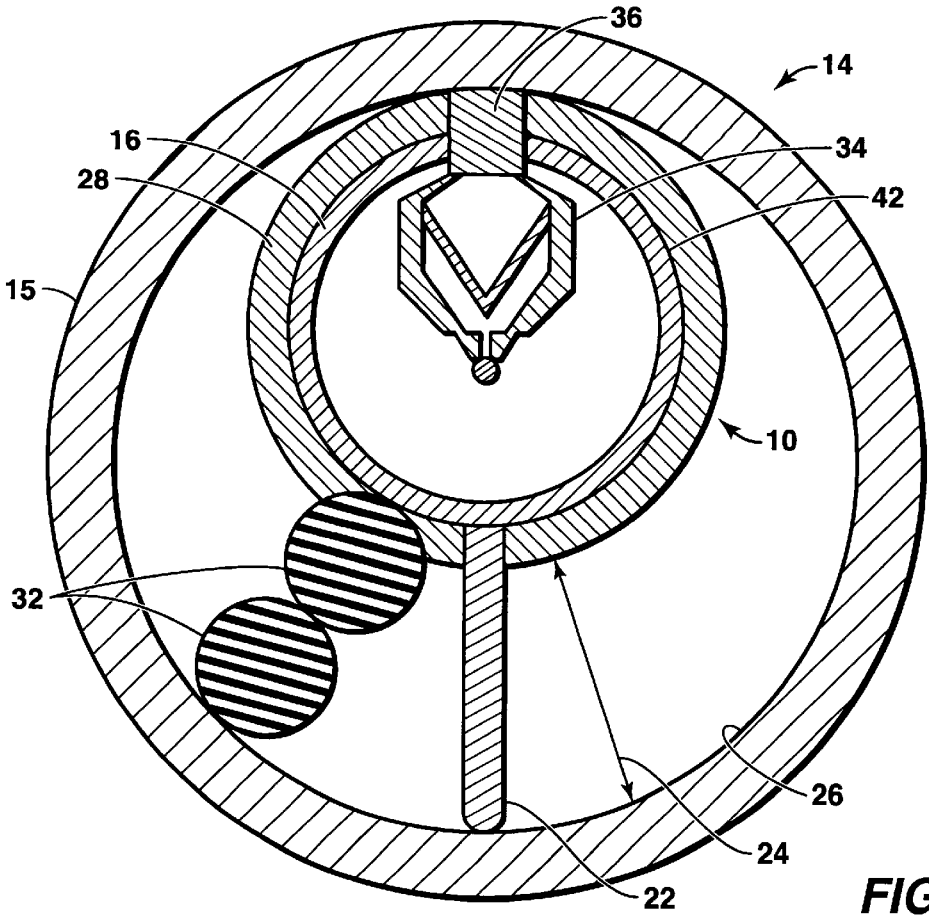
FIG. 2 is a top view of the apparatus illustrated in FIG. 1.

As can be seen in FIGS. 1 and 2, at least one decentralizer 22 is attached to at least one of the perforating devices 16 and is adapted to eccentrically position (from the longitudinal center axis of the wellbore 14) the perforating assembly within the cased wellbore 14 so as to create sufficient ball sealer clearance 24 (see FIG. 2) between the perforating assembly and the inner wall 26 of the well casing 15 to permit passage of at least one ball sealer 32. The decentralizer can also be used to control the orientation of the perforating charges relative to the casing wall and thus minimize the shot clearance and provide consistent diameter perforations. The decentralizer 22 shown in FIG. 1 forces the perforating assembly to a position within the wellbore 14 so as to provide sufficient clearance for the transport of ball sealers 32 past the perforating assembly. If the perforating device 16 has a sufficiently small diameter such that at least one ball sealer 32 may be transported past the perforating assembly when the assembly is centralized within the wellbore 14, then a centralizer (rather then a decentralizer) may be used to position the perforating assembly. However, another benefit to using decentralizer 22 is that it reduces the shot clearance 38 between the perforating devices 16 and the inner wall 26 of the well casing 15 so as to improve the perforation quality (e.g., to improve the consistency of perforation diameters, generate minimal burrs and reduce perforation ovality), particularly in the case where the shot phasing of the perforating devices 16 is near 0° (i.e., all shaped charges 34 are closely aligned; within approximately a 30° angle) and aimed at the nearest part of the well casing 15.

Decentralization of the perforating assembly can be achieved by several different pieces of equipment, including but not limited to: bow or other types of springs 22 (illustrated in FIGS. 1 and 4); mechanical arms; or magnetic decentralizers. A combination of any of these or other equivalents known to those skilled in the art may be used to eccentrically position the perforating assembly. The spacing of the decentralizers along the perforating assembly should be optimized to ensure that the perforating assembly is forced into contact with the inner wall 26 of the well casing 15 along the entire length of the perforating assembly. The decentralizing equipment should also be designed to ensure that the ball sealers 32 will not get lodged in the equipment when being transported down the wellbore 14 and to positively decentralize the assembly for the entire trip downhole. Materials for the bow spring, which have sufficiently high strength and hardness to resist yielding fatigue and wear, will be well known to those skilled in the art, such as but not limited to Elgiloy,™ Inconel, X750™ and MP35N.™ Additional wear resistance may be provided to the bow spring by applying a surface treatment, such as, but not limited to, tungsten-carbide cladding.

The apparatus 10 may also include at least one stand-off 28 which in FIGS. 1 and 2 are rings attached to the outer wall 42 (or carrier sleeve) of the perforating device 16 or to connector subs 18. The stand-off 28 is adapted to create an imposed shot clearance 38 (see FIG. 1) between the perforating assembly and the inner wall 26 of the well casing 15 when the perforating assembly is eccentrically positioned. When the apparatus 10 includes one or more stand-off 28 rings, then the required ball sealer clearance 24 must take into account the thickness of the stand-off 28 ring in addition to the outer diameter of the perforating devices 16.

The stand-off 28 will reduce the hydraulic force applied to the perforating assembly by the large pressure differential between the wellbore 14 and the formation that exists during over-balanced perforating. The imposed shot clearance 38 created by the stand-off 28 provides an optimum space for wellbore fluids to enter newly created perforations, thus modifying the pressure profile about the circumference of the perforating assembly and preventing the perforating devices 16 from blocking these perforations. The amount of imposed shot clearance 38 created by the stand-off 28 should be sufficient to provide adequate flow area between the perforating device 16 and the inner wall 26 of the well casing 15 for fluid to enter the perforations. The stand-off 28 should also be large enough to ensure the stiffness (i.e., resistance to bending) of the perforating device 16 balances the expected hydraulic forces.

As an example, for a perforating device 16, with an outside diameter of 2.00 inches, inside a well casing 15, with an inside diameter of 4.67 inches, the minimum ideal imposed shot clearance 38 created by the stand-off 28 to resist differential sticking is on the order of 5/16 of an inch. Computational fluid dynamics models, which will be well known to those skilled in the art, indicate that for 20 barrels per minute of flow into six 0.35 inch perforations centered on a given length of a perforating device 16, the applied hydraulic force would be approximately 4000 pounds. For a perforating device 16 of length 35 inches and the outside diameter given above, analytical models indicate that a force of approximately 5700 pounds would be necessary to bend the perforating device 16 by 5/16 of an inch at the center of its length. Therefore, the stiffness of the perforating device 16 is sufficient for the anticipated hydraulic force for this amount of stand-off.

The imposed shot clearance 38 may be created with several types of stand-off 28 components, including but not limited to: making the connector subs 18 larger than the perforating devices 16 by the desired amount (as shown in FIG. 1, the connector subs 18 have been modified to provide the stand-off 28; and the profile of the connector sub may take many different forms); incorporating a protuberance into the body of the connector sub; and adding rings or other physical barriers or protuberances (e.g., knobs) to the outer wall 42 of the perforating device 16. Such protuberances may be designed to provide a stable stand-off condition from the casing wall 26 while the perforating devices 16 are eccentrically positioned with the perforating charges 34 oriented towards the wall to provide the imposed clearance 38 and to provide a nearly perpendicular firing angle. Two examples of such protuberances include an asymmetric ring or two longitudinal pads offset along the circumference of the perforating device 16, although these examples are for illustration purposes and should not be limiting. One benefit of such asymmetric protuberances is a possible reduction in the material of the stand-off 28 that blocks the flow area past the perforating assembly (i.e., the perforating assembly "high side"), increasing the passage way for ball sealers 32 or other diversion agents. The spacing of the stand-off 28 components along the perforating assembly should be minimized so as to ensure that the length of the perforating device 16 between adjacent stand-off 28 components is small enough to resist bending.

Referring again to FIG. 1, the apparatus 10 also includes means for creating burr-free perforations in the cased wellbore 14 upon firing of the perforating charges 34. The phrase "burr-free" is intended to include (i) perforations where the circumference of the perforation on the inner wall 26 of the casing 15 is smooth and without any metal protrusions and (ii) perforations where the maximum height of the burr on the inner wall 26 of the casing is very small (for example, less than or equal to approximately 0.06 inches). Generally, when using a ball sealer with a flexible covering (e.g., a rubber coated ball sealer), the height of the resulting burrs on the perforations should be less than the thickness of the covering to promote optimum sealing.

Figure 3:
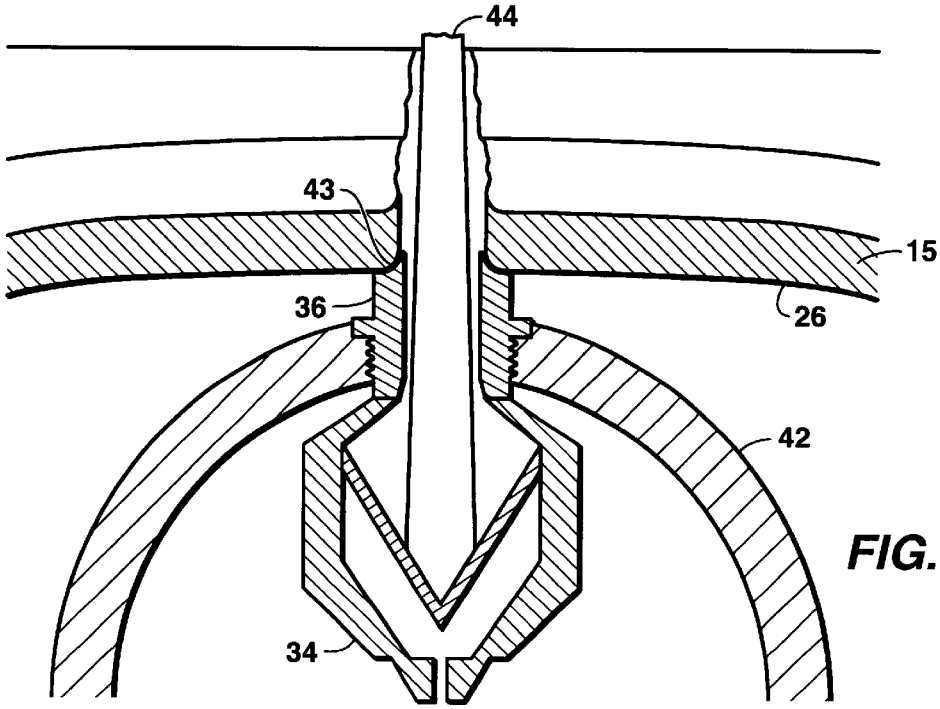
FIG. 3 illustrates one embodiment of the means for creating burr-free perforations.

One of the most common methods for achieving burr-free perforations is to use a port plug 36, for each of the perforating charges 34, that extends from the gun carrier sleeve 42 (see FIG. 2) and comes into direct contact with the well casing 15. As shown in FIG. 3, when the shaped charge 34 is fired (as illustrated by 44), the port plug 36 acts as a physical barrier that suppresses the burr, resulting in smoother surfaced perforations 43 for improved seating of the ball sealers 32. There are several other means well known to those skilled in the art for creating burr-free perforations. For example, a shaped charge could be designed such that, when fired, it wipes the burr off of the inner surface of the well casing and does not require any physical barrier like a port plug 36. Instead, the carrier sleeve outer wall 42 of the perforating devices 16 could also have multiple scalloped sections (sections of the outer wall which are thinner, and thus easier to perforate) which are positioned adjacent to the corresponding perforating charges 34. Obtaining burr-free perforations depends on the design of the components of the perforating charges 34, including the size of the charge, the type of the explosive, and the material and angle of the charge liner, and the clearance between the charge 34 and the casing wall 26. Bullet perforators tend to produce smooth, round perforations with little or no burr which are ideal for ball sealer seating. However, current bullet perforators are commonly found in sizes of 3.125-inch outer diameter or larger, with smaller sizes generally being less reliable. Therefore, their use in operations with ball sealers may be limited to cases where the well casing is large (i.e., greater than 6 inches of inside diameter).

FIG. 1 also illustrates a depth locator 37 which allows the wireline operator to monitor the depth of the apparatus 10 when in the wellbore 14. The phrase "depth locator" is intended to include any device or mechanism which could be used to control the depth of the apparatus 10 when in the wellbore 14, such as (but not by way of limitation) a casing collar locator or a gamma ray detector. Also, if it is desirable to isolate certain treatment zones (for example to isolate zones treated in a previous trip downhole), then a bridge plug 40 and setting tool 20 can also be attached to the apparatus 10. The phrase "bridge plug" is intended to include any device or mechanism which could be used to isolate treatment zones. Connector subs 18 can also be used to connect the setting tool 20 to the lower one 16*a* of the perforating devices and to connect the depth locator 37 to the upper one 16*c* of the perforating devices.

Figure 4:
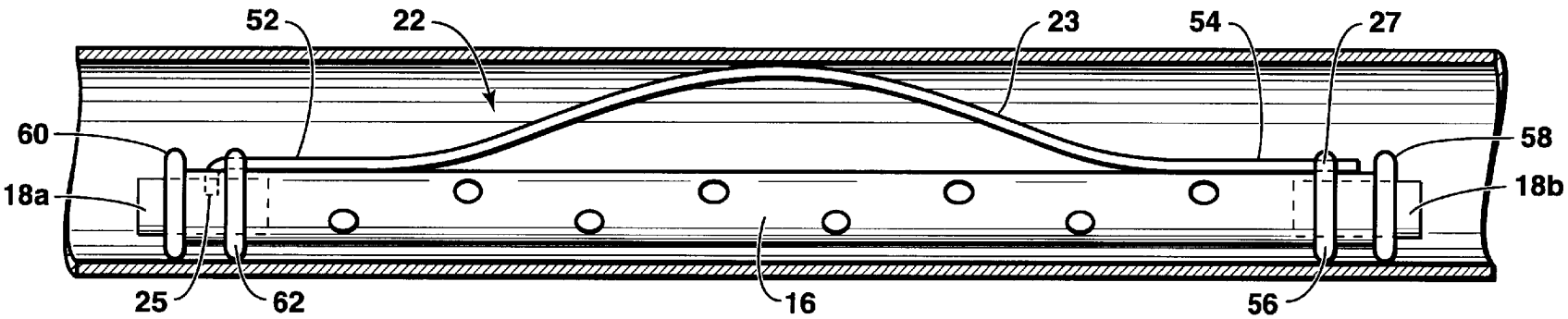
FIG. 4 is one embodiment of a decentralizer which can be a component of the apparatus of the present invention.

FIG. 4 illustrates one embodiment of a bow-spring decentralizer which could be used with the apparatus 10 of the present invention. The bow spring decentralizer 22 has a bow spring 23 which is directly attached to the perforating device 16. The bow spring 23 is attached via the connector subs 18*a* and 18*b* on each end of the perforating device 16. One end 52 of the bow spring 23 is either welded or secured in a hole 25 in the connector sub 18*a* by threads, roll pins with a notch, or other notch assemblies. The other end 54 of the bow spring 23 is held in position by running it through a hole 27 in stand-off ring 56 extending from the connector sub 18*b* (although it could run through any through-hole on or in the connector sub). This allows for end 54 of the bow spring 23 to slide back and forth in the hole 27 to compensate for compression and expansion of the bow spring 23. The clearance in this hole 27 should be small enough to prevent clogging by fines and yet large enough to reduce hole-spring galling. The bow spring 23 should be made of a material suitable for spring applications with yield and tensile strengths acceptable to meet the expected loading conditions during running, perforating, and other downhole applications. The bow spring 23 material should also be chosen to mitigate wear and corrosion/cracking concerns based on the expected downhole environment.

As can be seen from FIG. 4, connector subs 18*a* and 18*b* are standard single stand-off connector subs 18 (see FIG. 1) which have been modified. A standard connector sub has been expanded to accommodate a second ring 60 and 58, respectively, in each connector sub 18*a* and 18*b* with sufficient space between the adjacent rings (60 and 62 on connector sub 18*a*; 56 and 58 on connector sub 18*b*) to accommodate the bow spring 23 connections. This will generally necessitate that one ring per sub (ring 62 in connector sub 18*a*; ring 56 in connector sub 18*b*) be altered such that the bow spring 23 may be accommodated by each connector sub 18*a* and 18*b* as previously discussed. Ring 62 has been modified to allow the end 52 of the bow spring 23 to be secured into hole 25 of the connector sub 18*a*, still being flush with the perforating device 16, and ring 56 in connector sub 18*b* has been modified to provide for hole 27 to allow the lower end 54 of the bow spring 23 to slide back and forth in the hole 27. When using a threaded connection to connect end 52 of the bow spring 23 into the connector sub 18*a*, the connector sub 18*a* must be further altered by inclusion of a threaded hole (not shown) into the center of the connector sub 18*a* to mate with the bow spring 23.

One of the primary benefits of the bow spring decentralizer illustrated in FIG. 4 is that it has only one moving part, the bow spring 23. Multiple moving parts can provide locations for potential failure, resulting in a lack of decentralization or the inability to pull the perforating assembly out of the wellbore. The risk of failure can be further increased when the perforating assembly is in a proppant-laden fluid environment which can jam moving parts. Also, the bow spring decentralizer 22 illustrated in FIG. 4 is readily adaptable to work inline with select-fire perforating devices 16, rather than requiring "dummy" perforating device sections (i.e., containing no charges) to facilitate the decentralizer components and thus minimizing the overall length of the perforating assembly.

Figure 5A:
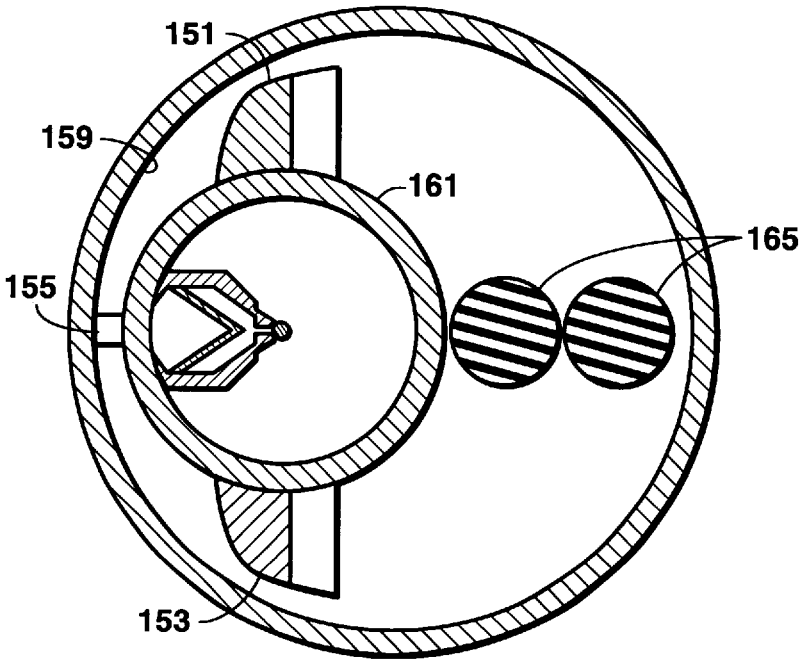
FIGS. 5A and 5B illustrate another embodiment of a decentralizer which can be a component of the apparatus of the present invention.
Figure 5B:
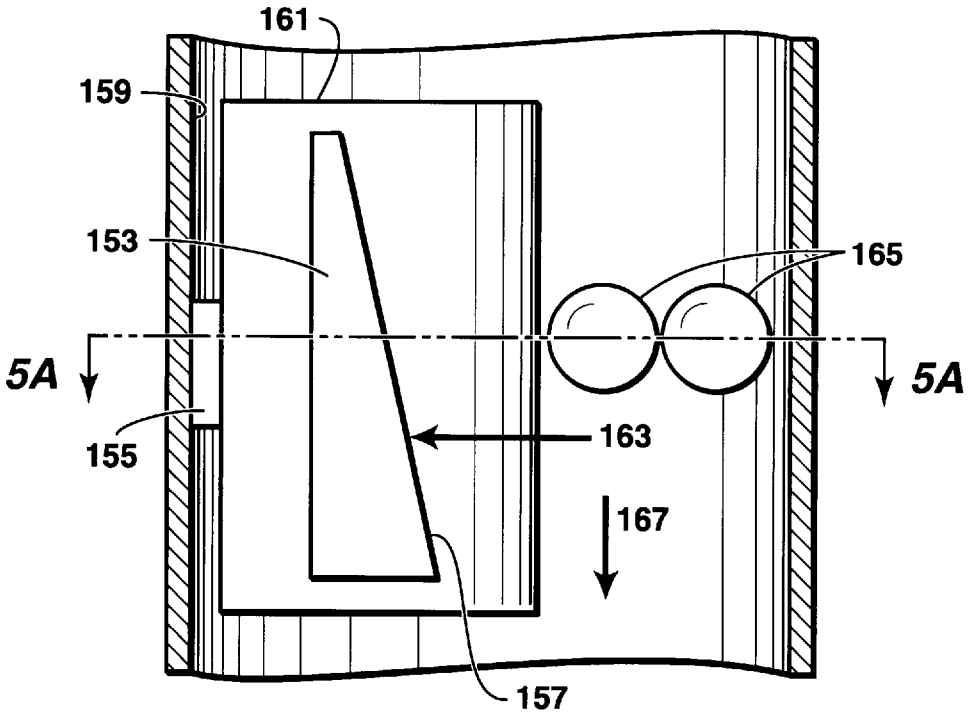

FIGS. 5A and 5B illustrate another embodiment for a decentralizer that could be used with the apparatus 10 of the present invention. This "hydrodynamic decentralizer" includes hydrofoils 151 and 153 and, if necessary, a stand-off protuberance 155 on the perforating device 161. During a JITP stimulation treatment, the perforating assembly is positioned above the interval being treated such that completion fluids are continuously flowing at high rates past the perforating assembly. This fluid flow is exploited to generate hydrodynamic forces that act to position the perforating assembly against the casing wall 159.

As shown in FIGS. 5A and 5B, in a manner similar to the way an airplane wing generates lift, the two hydrofoils 151 and 153 each possess an inclined surface 157 such that the nominally longitudinal flow 167 down the wellbore during the treatment is redirected and generates a force 163 perpendicular to the flow that pushes the perforating assembly against the casing wall 159. The stand-off protuberance 155 provides the necessary stand-off to create the desired shot clearance between the perforating device 161 and casing wall 159. However, this may be accomplished by the interference between the tips of the hydrofoils and the casing wall, or by the other means previously discussed for creating this shot clearance, such as with the stand-off rings on the connector subs (18, FIG. 1). The preferred geometric shape and quantity of the hydrofoils 151 and 153 and stand-off protuberances 155 would be designed and selected to provide for a stable and reliable positioning of the gun for the anticipated downhole flow conditions using principles and practices well-known to those skilled in the art of hydrodynamics and fluid dynamics design principles.

This hydrodynamic decentralizer offers advantages over other mechanical-type decentralizers. In particular, the entire decentralizer may be machined from a single block of material and would not possess any moving parts that could be damaged by deployment in a proppant-laden fluid environment. Alternatively, the hydrofoils 151 and 153 and stand-off protuberance 155 could be separately machined and then welded or attached by some mechanical fastener to the exterior of the perforating device 161 or to the connector subs (18, FIG. 3). Another benefit that this decentralizer has over mechanical decentralizers like bow springs is the increased flow area available for the passage of ball sealers 165. More specifically, with this design there is no obstruction in the annular space where the ball sealers 165 will flow past the perforating assembly. However, a potential drawback to using this hydrodynamic decentralizer 159 in JITP treatments is that it would not be effective for decentralizing the perforating assembly when perforating the very first interval, since no fluid flow 167 would be present to provide the decentralization force 163. This potential drawback could be mitigated by firing the perforating device 161 while it is being pulled across the first interval such that the hydrofoils 151 and 153 are exposed to the fluid flow relative to the upward motion of the perforating assembly. Alternatively, the hydrofoils may be designed with magnets on the outer tips in proximity to the casing to ensure proper positioning.

Referring now to FIG. 1, as previously discussed, differential sticking of perforating devices 16 can be detrimental to multi-stage perforating/fracturing processes where maintaining an applied pressure and where fracturing slurry injection rate are critical to the success of the operation. Previously, gun sticking has been alleviated by reducing the injection rate and/or the applied wellhead pressure. However, in diversion operations where ball sealers 32 are needed to seal previously stimulated intervals, a loss in pressure can cause the balls sealers 32 to unseat and therefore disrupt the procedure. One alternative is to pull the perforating assembly (via the wireline 12) up the wellbore 14 and out of the region of sticking without reducing the pressure or injection rate of the wellbore 14 fluids. The restricting factor is the static frictional forces between the perforating device 16 and the casing 15 which cannot be overcome with the limited tensile strength of the wireline 12. In some instances, sticking of the perforating assembly has been prevented by "perforating while running", i.e., pulling the perforating assembly up the wellbore as the shaped charges are fired. However, because of the large hydraulic forces involved, such actions do not guarantee that the perforating assembly will not get sucked towards the perforations before being removed from the sticking region.

As illustrated in FIGS. 6A–6C and 7A–7B, enhancements to standard connector subs 70 between perforating devices 16 can make it possible to remove the perforating assembly out of the sticking region without reducing the pressure or injection rate of the wellbore fluid. As described further below, this is possible by: (i) reducing the radial load on the perforating device 16 (and thus the frictional load) by providing the imposed shot clearance 74 between the surface of the perforating device 16 and the perforated casing surface 26; and (ii) providing low friction rollers on the connector subs 70 to allow the entire perforating assembly to roll along the inner wall 26 of the casing 15 while being pulled up by applied force 97, which could be exerted by any suitable means, such as a wireline, and out of the region of differential sticking.

Figure 6B:
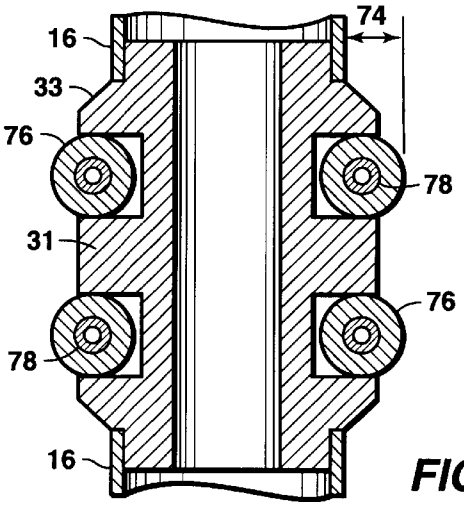
FIGS. 6A–6C illustrate one embodiment of a connector sub which can be a component of the apparatus of the present invention.
Figure 6C:
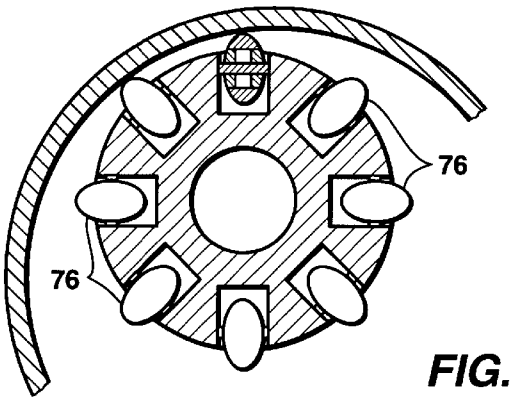
Figure 6A:
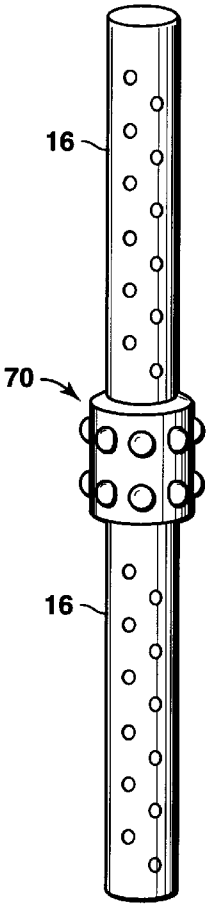

More specifically, FIG. 6A illustrates a connector sub 70, with both cross-sectional and top side views (FIGS. 6B and 6C, respectively). The frame 31 of the connector sub 70 has a diameter larger than the perforating devices 16 in part to accommodate the space needed for the rollers 76, but also to provide at least a portion of the required imposed shot clearance 74. The frame 31 has tapered edges 33 to reduce the chance of getting caught up on anything downhole. In this embodiment, there are two sets of rollers 76 as shown in FIG. 6A, with each set consisting of six to eight rollers evenly spaced about the circumference of the connector sub 70. The number of rollers 76 depends on the size of the connector sub 70, although eight rollers would be preferred (if the connector sub 70 is sufficiently large to accommodate this many rollers) to assure minimal contact between the connector sub frame 31 and the casing. In an alternate configuration for a perforating device 16, rollers that are located away from the casing wall 26 on the flow area side of the device (the tool "high side") may be eliminated since they are not expected to contact the casing wall 26. The presence of these tool high-side rollers reduces the flow area and causes a restriction in the passage way for ball sealers 32 or other diversion agents.

Referring to FIGS. 6A–6C, the distance from the connector sub 70 centerline to each roller's 76 outer edge is selected to provide the imposed shot clearance 74 required to reduce the hydraulic forces on the perforating device 16. The rollers 76 are preferably made of a hard but rubbery material, such as an elastomer or other polymeric material, which is capable of rolling over any burrs on the perforations. The rollers 76 roll on low-friction bearings 78 which rotate about a shaft across the cavity in the connector sub 70. The design of the rollers 76 is analogous to the wheels and bearings found on in-line skates. The rollers 76 are shown with curved surfaces in order to minimize the surface contact area between the rollers and the inner wall 26 of the casing 15. However, rollers with flat surfaces (i.e., similar to wheels used on office chairs) could also be employed. The imposed shot clearance 74 increases the space between the surface of the perforating device 16 and the inner wall 26 of the casing 15, so for a given flow rate of treatment fluid, the fluid velocity (and thus the shear rate) between these two surfaces is not critically high as the fluid enters the perforations.

Figure 7B:
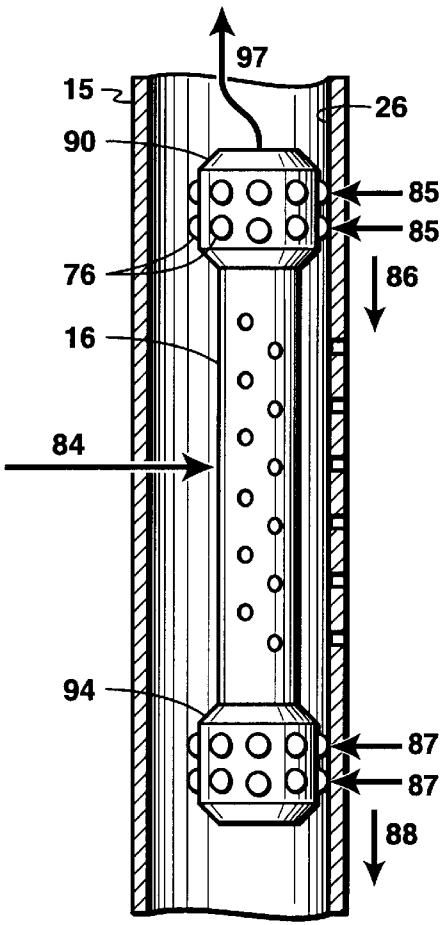
FIGS. 7A and 7B illustrate, respectively, the forces acting on a perforating assembly without the modified connector sub illustrated in FIGS. 6A–6C and a perforating assembly with the modified connector sub.
Figure 7A:
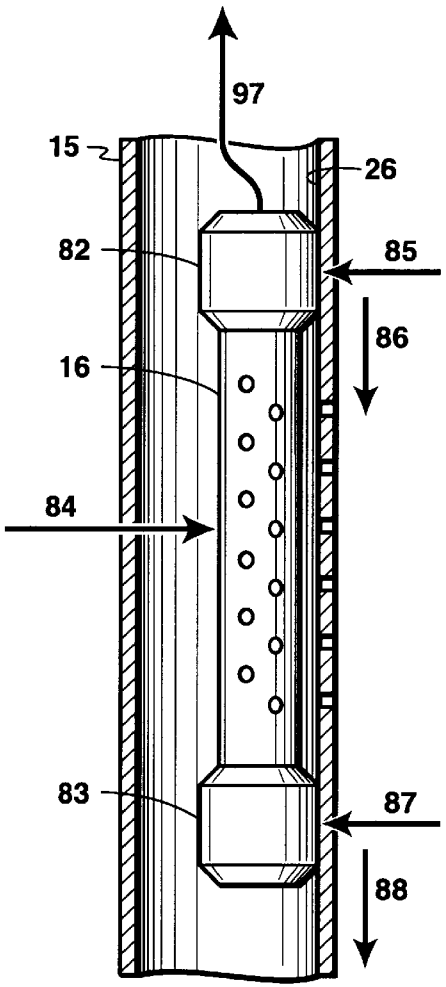

As described further below, while the imposed shot clearance 74 (illustrated in FIG. 6B) provides the benefit described above, under some circumstances it may not guarantee that the perforating assembly can be pulled up the wellbore and out of the sticking region. FIG. 7A illustrates the forces applied to the surface of a perforating device 16 having standard connector subs 82 and 83, and FIG. 7B illustrates the applied forces with modified connector subs 90 and 94. Referring now to FIG. 7A, the reaction forces 85 and 87 ("N") for each connector sub 82 and 83, respectively will be half of the differential pressure drag force (sticking load) 84 ("F") applied to the perforating device 16 (i.e., N=0.5F), which corresponds to a substantial frictional force ("f") 86 and 88 at each of these contact areas, where $f=\mu N$ (with g being the coefficient of static friction) which must be overcome by applied force 97 before the gun assembly will move. Secondly, there is no guarantee that the connector subs 82 and 83 will be able to slide over any burrs on the resulting perforations.

Referring now to FIG. 7B, the benefits of the modified connector subs 90 and 94 having rollers 76 are: (i) to provide a broader distribution of the reaction forces 85 and 87 (depending on how many rollers 76 are in contact with the casing surface 26); (ii) no need to overcome the static friction of the wheel-to-metal contact since the friction will depend on the performance of the bearings 78 (FIG. 6B); and (iii) the rollers 76 will have a better chance of getting over burrs on the perforations. The ultimate effect of the modified connector subs 90 and 94 is to reduce the magnitude of the applied force 97 required to pull the perforating device out of the sticking region.

Figure 8:
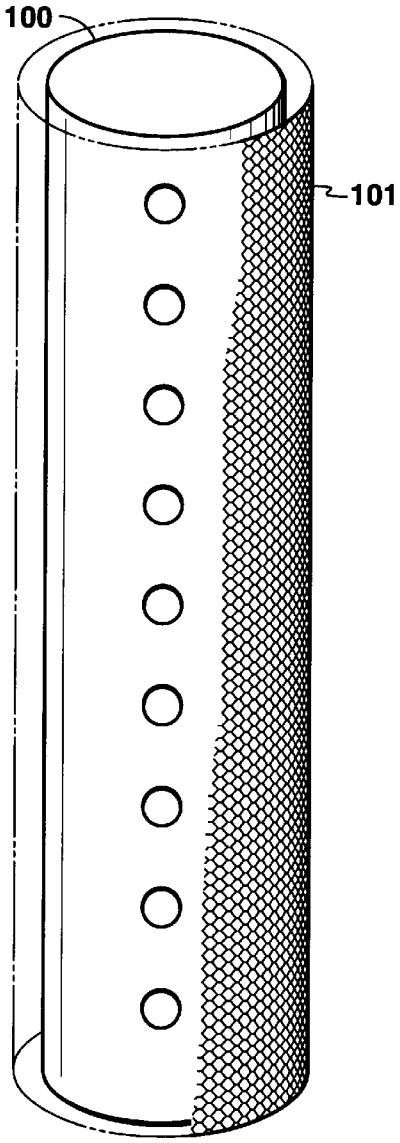
FIGS. 8 and 9 illustrate two additional embodiments of a perforating device which can be used in a perforating assembly to prevent sticking of perforating devices when perforating in overbalanced conditions.
Figure 9:
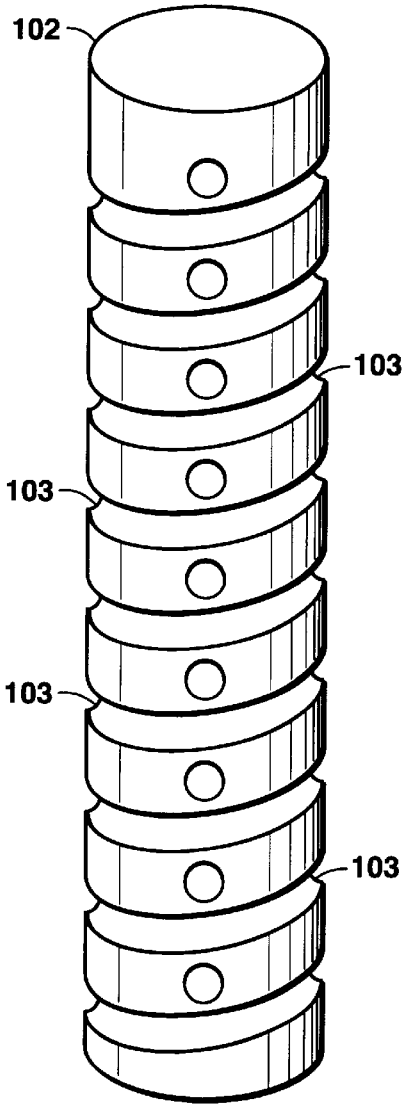

FIGS. 8 and 9 also illustrate two other embodiments to prevent sticking of perforating devices when perforating in over-balanced conditions. FIG. 8 illustrates a perforating device 100 having an outer permeable sleeve 101 around the perforating device 100 to allow flow of treating fluid past the perforating device 100. This sleeve 101 may be a wire mesh or screen or perhaps a high-strength fabric such as Kevlar™. The optimal design concept should be determined on the basis of further engineering and laboratory testing well known to those skilled in art. FIG. 9 illustrates a perforating device 102 which has constructed machine grooves 103 on the surface of the perforating device 102 to allow flow to the underside of the perforating device 102 (similar in concept to spiral drill collars but with different geometric parameters). These grooves 103 should have a significant longitudinal helix to allow the gun to ride over any perforation burrs although non-helically grooved arrays are also within the scope of this embodiment. These embodiments are different from some other means, such as placing stand-off rings along the perforating device, because they may be more effective for limber gun assemblies since the "stick-free" mechanism is distributed along the body of the perforating device. Also, the outer diameter of the perforating device is reduced, allowing flow of ball sealers 32 past the perforating device 102 in smaller casing sizes or with larger diameter perforating assemblies.

Another embodiment of the perforating gun assembly of the present invention is an apparatus for use in perforating multiple intervals of a subterranean formation intersected by a cased wellbore and in treating the multiple intervals using a diversion agent other than ball sealers. The apparatus comprises a perforating assembly, as described above and illustrated in FIG. 1, having a plurality of select-fire perforating devices 16 interconnected by connector subs 18 with each of the select-fire perforating devices 16 having multiple perforating charges 34. At least one decentralizer 22 is adapted to eccentrically position the perforating assembly within the cased wellbore 14 so as to create sufficient diversion agent clearance between the perforating assembly and the inner wall 26 of the well casing 15 to (i) permit passage of the diversion agent with reduced frictional losses when the diversion agent flows past the perforating assembly and (ii) treat at least one interval following perforation of the interval. The diversion agent comprises at least one of sand, ceramic material, proppant, salt, polymers, waxes, resins, viscosified fluid, foams, gelled fluids, or chemically formulated fluids. This embodiment can also include any of the other components and their various embodiments, such as a stand-off, means for creating burr-free perforations in the cased wellbore, depth locator, bridge plug, or bridge plug setting tool described above.

The various embodiments of the inventive perforating gun assembly and the components related thereto are described in general terms because there are several types of equipment or mechanisms that can be used to serve the function of those components. The foregoing description is not intended to represent the only options for the choice of those components. On the contrary, any piece of equipment or mechanism, whether pre-existing or newly designed, that can serve the purpose of a given component is an acceptable choice for that component. Various alterations and modifications of the embodiments described above will be apparent to those skilled in the art without departing from the true scope of the invention, including any equivalents thereof, as defined by the appended claims.

We claim:

1. An apparatus for use in perforating multiple intervals of at least one subterranean formation intersected by a cased wellbore and in treating said multiple intervals using ball sealers as a diversion agent, said apparatus comprising:

(a) at least one select-fire perforating device having multiple perforating charges;

(b) at least one depth locator attached to said perforating device; and (c) at least one decentralizer attached to said perforating device, said decentralizer adapted to eccentrically position said perforating device within said cased wellbore so as to create sufficient ball sealer clearance between said perforating device and the inner wall of said cased wellbore to permit passage of at least one ball sealer.

2. The apparatus of claim 1 further comprising at least one stand-off positioned on said perforating device so as to create an imposed shot clearance between said perforating device and the inner wall of said cased wellbore when said perforating device is eccentrically positioned.

3. The apparatus of claim 2 wherein said stand-off comprises at least one protuberance attached to said perforating device.

4. The apparatus of claim 3 wherein said protuberance comprises at least one ring attached to said perforating device.

5. The apparatus of claim 1 wherein said perforating device further comprises means for creating burr-free perforations in said cased wellbore upon firing of said perforating charges.

6. The apparatus of claim 5 wherein said means for creating burr-free perforations in said cased wellbore comprises multiple scalloped sections within the inner wall of said perforating device, each of said scalloped sections positioned adjacent to said corresponding perforating charges.

7. The apparatus of claim 5 wherein said means for creating burr-free perforations in said cased wellbore comprises port plugs corresponding to each of said perforating charges.

8. The apparatus of claim 1 further comprising a bridge plug setting tool and a bridge plug connected to the lower end of said apparatus.

9. The apparatus of claim 1 wherein said perforating device further comprises connector subs attached at each end of said perforating device and wherein said decentralizer comprises a bow spring having first and second ends, said first end of said bow spring attached to one of said connector subs and said second end of said bow spring slidably mounted to the other one of said connector subs.

10. The apparatus of claim 1 wherein said decentralizer comprises at least two hydrofoil sections attached to said perforating device, said hydrofoil sections adapted to generate a radially outward force to eccentrically position said perforating assembly in response to axial flow of treating fluid down said wellbore.

11. The apparatus of claim 10 wherein each of said hydrofoil sections has at least one magnet attached to the tip of each of said hydrofoil sections.

12. The apparatus of claim 1 further comprising at least one connector sub, said connector sub having multiple rollers adapted to roll along the inner wall of said cased wellbore when said apparatus is moved to a different axial position in said wellbore.

13. The apparatus of claim 1 wherein said perforating device further comprises a permeable sleeve surrounding at least a portion of said perforating device, said permeable sleeve adapted to promote the flow of treating fluid past said perforating device and into the perforations created by firing at least a portion of said perforating charges.

14. The apparatus of claim 1 wherein said perforating device further comprises grooved arrays constructed in the casing of said perforating device, said grooved arrays adapted to promote the flow of treating fluid past said perforating device and into the perforations created by firing at least a portion of said perforating charges.

15. An apparatus for use in perforating multiple intervals of at least one subterranean formation intersected by a cased wellbore and in treating said multiple intervals using ball sealers as a diversion agent, said apparatus comprising:

(a) a perforating assembly comprising a plurality of select-fire perforating devices interconnected by connector subs, each of said perforating devices having multiple perforating charges;

(b) at least one depth locator connected to said perforating assembly; and (c) at least one decentralizer attached to at least one of said perforating devices, said decentralizer adapted to eccentrically position said perforating assembly within said cased wellbore so as to create sufficient ball sealer clearance between said perforating assembly and the inner wall of said cased wellbore to permit passage of at least one ball sealer.

16. The apparatus of claim 15 further comprising at least one stand-off positioned on said perforating assembly so as to create an imposed shot clearance between said perforating assembly and the inner wall of said cased wellbore when said perforating assembly is eccentrically positioned.

17. The apparatus of claim 16 wherein said stand-off comprises at least one protuberance attached to said perforating assembly.

18. The apparatus of claim 17 wherein said protuberance comprises at least one ring attached to said perforating assembly.

19. The apparatus of claim 15 wherein each of said perforating devices further comprises means for creating burr-free perforations in said cased wellbore upon firing of said perforating charges.

20. The apparatus of claim 19 wherein said means for creating burr-free perforations in said cased wellbore comprises multiple scalloped sections within the inner wall of each of said perforating devices, each of said scalloped sections positioned adjacent to said corresponding perforating charges.

21. The apparatus of claim 19 wherein said means for creating burr-free perforations in said cased wellbore comprises port plugs corresponding to each of said perforating charges.

22. The apparatus of claim 15 further comprising a bridge plug setting tool and a bridge plug connected to the lower end of the lower most one of said multiple perforating devices.

23. The apparatus of claim 15 wherein said decentralizer comprises a bow spring having first and second ends, said first end of said bow spring attached to one of said connector subs and said second end of said bow spring slidably mounted to another one of said connector subs.

24. The apparatus of claim 15 wherein said decentralizer comprises at least two hydrofoil sections attached to at least one of said perforating devices, said hydrofoil sections adapted to generate a radially outward force to eccentrically position said perforating assembly in response to axial flow of treating fluid down said wellbore.

25. The apparatus of claim 24 wherein each of said hydrofoil sections has at least one magnet attached to the tip of each of said hydrofoil sections.

26. The apparatus of claim 15 wherein at least one of said connector subs comprises multiple rollers adapted to roll along the inner wall of said cased wellbore when said perforating assembly is moved to a different axial position in said wellbore.

27. The apparatus of claim 15 wherein said perforating assembly further comprises a permeable sleeve surrounding at least a portion of said perforating assembly, said permeable sleeve adapted to promote the flow of treating fluid past said perforating assembly and into the perforations created by firing at least a portion of said perforating charges.

28. The apparatus of claim 15 wherein each of said perforating devices further comprises grooved arrays constructed in the casing of said perforating device, said grooved arrays adapted to promote the flow of treating fluid past said perforating devices and into the perforations created by firing at least a portion of said perforating charges.

29. An apparatus for use in perforating multiple intervals of at least one subterranean formation intersected by a cased wellbore and in treating said multiple intervals using ball sealers as a diversion agent, said apparatus comprising:

(a) a perforating assembly comprising a plurality of select-fire perforating devices interconnected by connector subs, each of said perforating devices having multiple perforating charges;

(b) at least one depth locator connected to said perforating assembly;

(c) at least one decentralizer attached to at least one of said perforating devices, said decentralizer adapted to eccentrically position said perforating assembly within said cased wellbore so as to create sufficient ball sealer clearance between said perforating assembly and the inner wall of said cased wellbore to permit passage of at least one ball sealer; and (d) at least one stand-off positioned on said perforating assembly so as to create an imposed shot clearance between said perforating assembly and the inner wall of said cased wellbore when said perforating assembly is eccentrically positioned.

30. The apparatus of claim 29 wherein said stand-off comprises at least one protuberance attached to said perforating assembly.

31. The apparatus of claim 30 wherein said protuberance comprises at least one ring attached to said perforating assembly.

32. The apparatus of claim 29 wherein each of said perforating devices further comprises means for creating burr-free perforations in said cased wellbore upon firing of said perforating charges.

33. The apparatus of claim 32 wherein said means for creating burr-free perforations in said cased wellbore further comprises port plugs corresponding to each of said perforating charges.

34. The apparatus of claim 32 wherein said means for creating burr-free perforations in said cased wellbore further comprises multiple scalloped sections within the inner wall of each of said perforating devices, each of said scalloped sections positioned adjacent to said corresponding perforating charges.

35. The apparatus of claim 29 further comprising a bridge plug setting tool and bridge plug connected to the lower end of the lower most one of said multiple perforating devices.

36. The apparatus of claim 29 wherein said decentralizer comprises a bow spring having first and second ends, said first end of said bow spring attached to one of said connector subs and said second end of said bow spring slidably mounted to another one of said connector subs.

37. The apparatus of claim 29 wherein said decentralizer comprises at least two hydrofoil sections attached to at least one of said perforating devices, said hydrofoil sections adapted to generate a radially outward force to eccentrically position said perforating assembly in response to axial flow of treating fluid down said wellbore.

38. The apparatus of claim 37 wherein each of said hydrofoil sections has at least one magnet attached to the tip of each of said hydrofoil sections.

39. The apparatus of claim 29 wherein at least one of said connector subs comprises multiple rollers adapted to roll along the inner wall of said cased wellbore when said perforating assembly is moved to a different axial position in said wellbore.

40. The apparatus of claim 29 wherein said perforating assembly further comprises a permeable sleeve surrounding at least a portion of said perforating assembly, said permeable sleeve adapted to promote the flow of treating fluid past said perforating assembly and into the perforations created by firing at least a portion of said perforating charges.

41. The apparatus of claim 29 wherein each of said perforating devices further comprises grooved arrays constructed in the casing of said perforating devices, said grooved arrays adapted to promote the flow of treating fluid past said perforating devices and into the perforations created by firing at least a portion of said perforating charges.

42. An apparatus for use in perforating multiple intervals of at least one subterranean formation intersected by a cased wellbore and in treating said multiple intervals using a diversion agent, said apparatus comprising:

(a) a perforating assembly comprising a plurality of select-fire perforating devices interconnected by connector subs, each of said perforating devices having multiple perforating charges;

(b) at least one decentralizer attached to at least one of said perforating devices, said decentralizer adapted to eccentrically position said perforating assembly within said cased wellbore so as to create sufficient diversion agent clearance between said perforating assembly and the inner wall of said cased wellbore to permit passage of said diversion agent past said perforating assembly and treat at least one of said multiple intervals following perforation of said interval; and (c) at least one depth locator attached to said perforating assembly.

43. The apparatus of claim 42 wherein said diversion agent clearance is sufficient to permit passage of a diversion agent comprising at least one of sand, ceramic material, proppant, salt, waxes, resins, polymers, viscosified fluids, foams, gelled fluids, or chemically formulated fluids.

44. The apparatus of claim 42 further comprising at least one stand-off positioned on said perforating assembly so as to create an imposed shot clearance between said perforating assembly and the inner wall of said cased wellbore when said perforating assembly is eccentrically positioned.

45. The apparatus of claim 44 wherein said stand-off comprises at least one protuberance attached to said perforating assembly.

46. The apparatus of claim 45 wherein said protuberance comprises at least one ring attached to said perforating assembly.

47. The apparatus of claim 45 wherein each of said perforating devices further comprises means for creating burr-free perforations in said cased wellbore upon firing of said perforating charges.

48. The apparatus of claim 47 wherein said means for creating burr-free perforations in said cased wellbore comprises multiple scalloped sections within the inner wall of each of said perforating devices, each of said scalloped sections positioned adjacent to said corresponding perforating charges.

49. The apparatus of claim 47 wherein said means for creating burr-free perforations in said cased wellbore comprises port plugs corresponding to each of said perforating charges.

50. The apparatus of claim 42 further comprising a bridge plug setting tool and bridge plug connected to the lower end of the lower most one of said multiple perforating devices.

* * * * *